US006514004B2

(12) United States Patent
Horiguchi

(10) Patent No.: US 6,514,004 B2
(45) Date of Patent: Feb. 4, 2003

(54) CONNECTING STRUCTURE FOR PIECES OF A STRAP MADE OF HARD MATERIALS

(75) Inventor: Hideo Horiguchi, Chiba (JP)

(73) Assignee: Glory Co., Ltd., Tokyo (JP)

( * ) Notice: Subject to any disclaimer, the term of this patent is extended or adjusted under 35 U.S.C. 154(b) by 98 days.

(21) Appl. No.: 09/738,595

(22) Filed: Dec. 15, 2000

(65) Prior Publication Data

US 2002/0012569 A1 Jan. 31, 2002

(30) Foreign Application Priority Data

Jul. 28, 2000 (JP) ..... 2000-230050
Sep. 14, 2000 (JP) ..... 2000-280578

(51) Int. Cl.[7] ..... F16B 21/08
(52) U.S. Cl. ..... 403/408.1
(58) Field of Search ..... 403/155, 154, 403/150, 151, 161, 320, 326, 318, 379.2, 408.1

(56) References Cited

U.S. PATENT DOCUMENTS 3,997,989 A * 12/1976 Stepe ..... 37/457
4,330,923 A * 5/1982 Cummings ..... 29/434
4,627,761 A * 12/1986 Olson et al. ..... 403/324
4,918,843 A * 4/1990 Kiesewetter et al. ..... 37/455
5,492,417 A * 2/1996 Baker et al. ..... 384/448
6,092,958 A * 7/2000 Gale ..... 403/378

FOREIGN PATENT DOCUMENTS

JP 63-197410 8/1988 ..... A47J/19/00

* cited by examiner

*Primary Examiner*—Robert E. Pezzuto
(74) *Attorney, Agent, or Firm*—Darby & Darby

(57) ABSTRACT

A connecting structure for swingably connecting two parts such as adjacent pieces and the like of a band includes a plurality of connecting pipes provided on the adjacent parts and aligned along an axis. A connecting pin is inserted into the connecting pipes and carries a C-shaped spring ring which engages with an installation groove of the connecting pin in a manner such that the diameter of the spring ring can be reduced. The connecting pin, together with the spring ring is inserted into the connecting pipes by reducing the diameter thereof, and fastens the connecting pin to the connecting pipes by enlarging the diameter of the spring ring inside the connecting pipes until the outer surface of the spring ring contacts the inner surface of the connecting pipes.

9 Claims, 6 Drawing Sheets

CONNECTING STRUCTURE FOR PIECES OF A STRAP MADE OF HARD MATERIALS

BACKGROUND OF THE INVENTION

1. Field of the Invention

The present invention relates to a connecting structure for pieces which are made of hard materials such as metals and the like, for swingably connecting two parts, such as adjacent pieces of a wristband of a watch, a piece and a case of a watch, or a piece and a buckle of a watch (hereinafter called "piece" or "pieces and the like"), with a connecting pin.

2. Description of the Related Art

In the wristbands of watches which are constructed by a plurality of metal pieces swingably connected with connecting pins, structures are known in which some pieces can be relatively easily removed by pulling the connecting pins out in order to adjust the length of the wristband to fit the thickness of the user's wrist.

A structure for connecting adjacent pieces by inserting a hairpin-shaped connecting pin into the overlapped connecting pipes of the adjacent pieces until an engaging portion of the connecting pin deforms, has been proposed as one of the connecting structures for adjusting the length of a wristband. Furthermore, a structure engaging a pipe, which has a C-shaped cross section, between the overlapped connecting pipes and for connecting the pieces by forcibly inserting the connecting pin into the C-shaped pipe, has also been proposed.

However, the structure using the hairpin-shaped connecting pin has problems in that a stable connecting force cannot be obtained, and an undesirable deformation and break may occur as time passes. Furthermore, the structure using the C-shaped pipe has problems in that an additional process for forming the portion which position the C-shaped pipe having a diameter larger than that of the normal connecting pipe in addition to a process for forming the connecting pipe, hence, two processes using two drills with different diameters, are required. Moreover, the structure has additional problems in that the connecting process is laborious and time-consuming.

The present invention is provided to solve the above problems, and an object of the present invention is to provide a connecting structure for the pieces and the like in which a desirable connecting force can be obtained.

Another object of the present invention is to provide a connecting structure for the pieces and the like which offers high operability.

A further object of the present invention is to provide a connecting structure for the pieces and the like which offers high durability.

SUMMARY OF THE INVENTION

To achieve at least one of the above objects of the present invention, the present invention provides a connecting structure for swingably connecting two parts such as adjacent pieces and the like of a band and comprises: a plurality of connecting pipes which are provided on the adjacent parts and aligned along the same axis; a connecting pin which is inserted into the connecting pipes; and a C-shaped spring ring which is engaged with an installation groove of said connecting pin in a manner such that the diameter of the spring ring can be reduced; and wherein, together with the connecting pin, the spring ring is inserted into the connecting pipes by reducing the diameter of the spring ring, and fastens the connecting pin to the connecting pipes by enlarging the diameter of the spring ring inside the connecting pipes until the outer surface of the spring ring contacts the inner surface of the connecting pipes.

In this connecting structure, it is preferable that the spring ring is enlarged in a tapered connecting groove which is provided on the inner surface of said connecting pipes, and to fasten the connecting pin to the connecting pipes by engaging the outer part of the spring ring with the connecting groove.

Furthermore, in this connecting structure, it is preferable that at least one or more connecting grooves are provided at an intermediate portion along the longitudinal direction of the aligned connecting pipes.

Furthermore, in this connecting structure, it is preferable that the aligned connecting pipes are composed of a pair of first connecting pipes which are provided at both sides of an end of one of the adjacent parts and a second connecting pipe which is provided at an portion of the other adjacent part, the second connecting pipe is engaged between the pair of first connecting pipes aligned along the same axis, and the connecting groove is provided at one of the end portion of either the first or second connecting pipes which are adjacent to each other, or provided across the end portions of both the first and second connecting pipes which are adjacent to each other.

Furthermore, in the connecting structure of the present invention, a pair of portions which lead to the opening ends of the spring ring may be formed into straight-lined shapes.

DESCRIPTION OF THE PREFERRED EMBODIMENTS

Preferred embodiments will be explained as follows with reference to the figures.

FIGS. 1 to 4 show an embodiment of the connecting structure for the pieces and the like of the present invention. In each of these figures, reference number 1 denotes a piece which forms a wristband of a watch, and the adjacent pieces 1 are connected by a connecting pin 3 and two spring rings 5.

Figure 1:
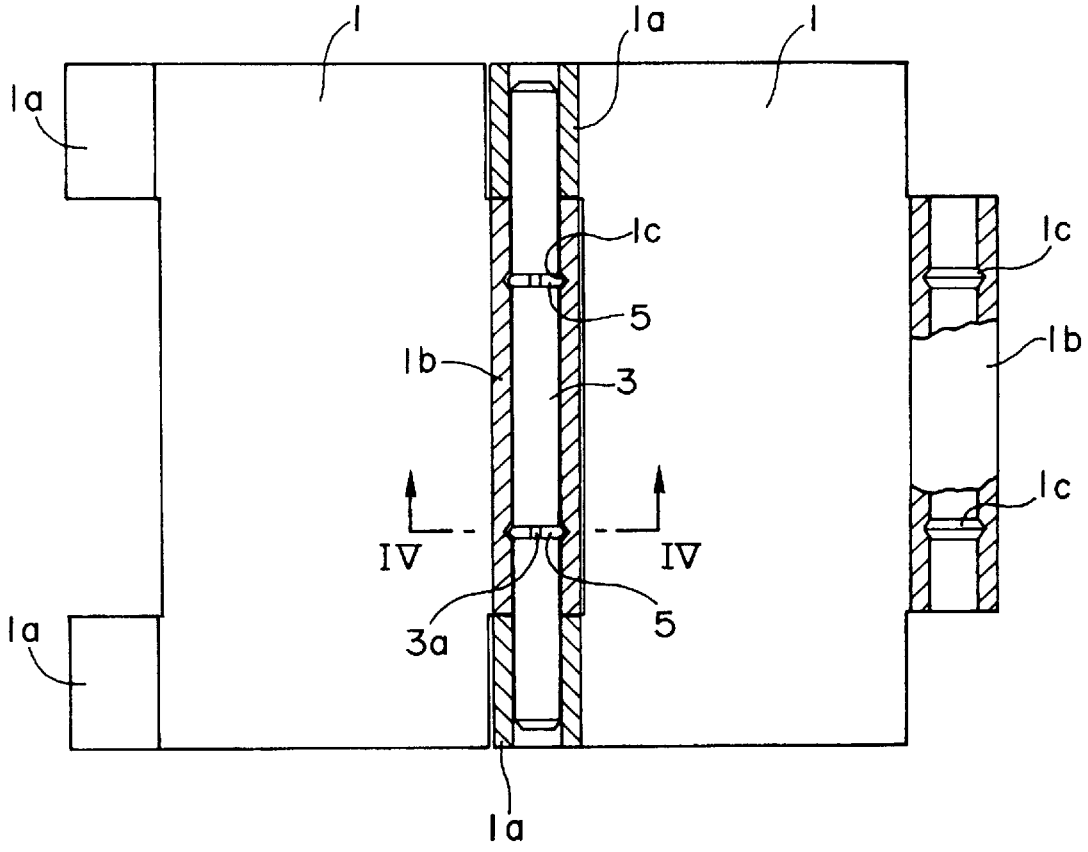
FIG. 1 is a cross-sectional view of an embodiment of the connecting structure for the pieces and the like of the present invention.
Figure 2:
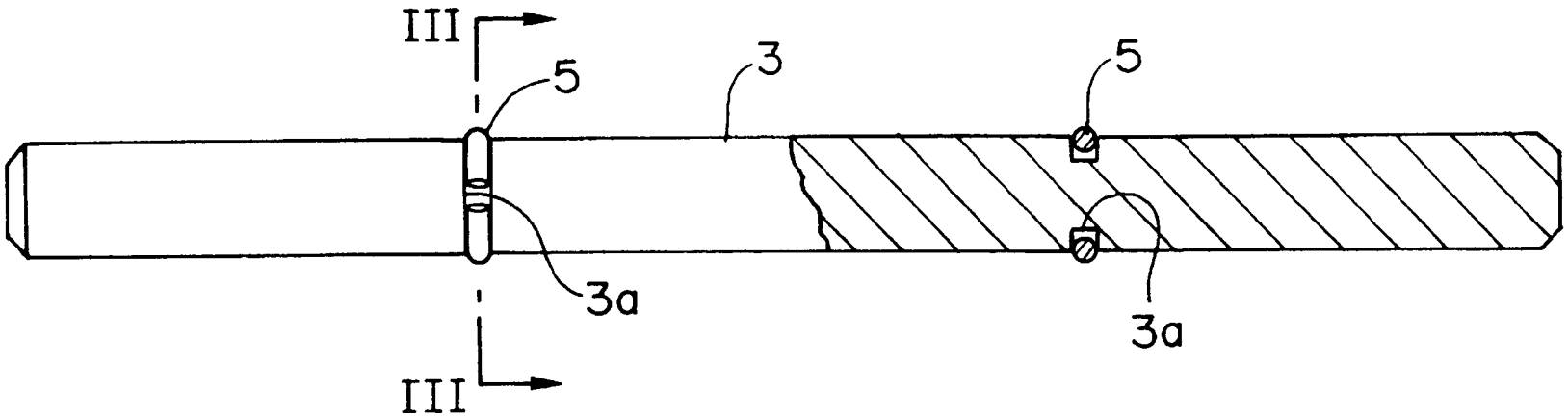
FIG. 2 is a partial cross-sectional view of spring rings which are engaged in the installation grooves of the connecting pin.
Figure 3:
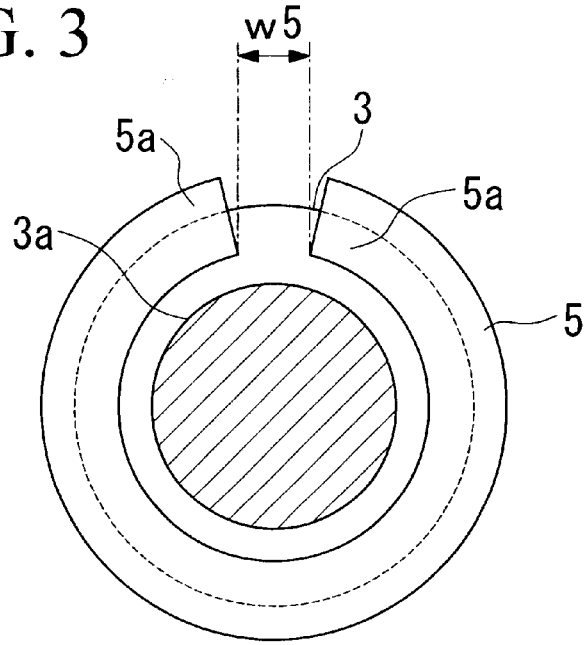
FIG. 3 is a cross-sectional view along the line III—III in FIG. 2.
Figure 4:
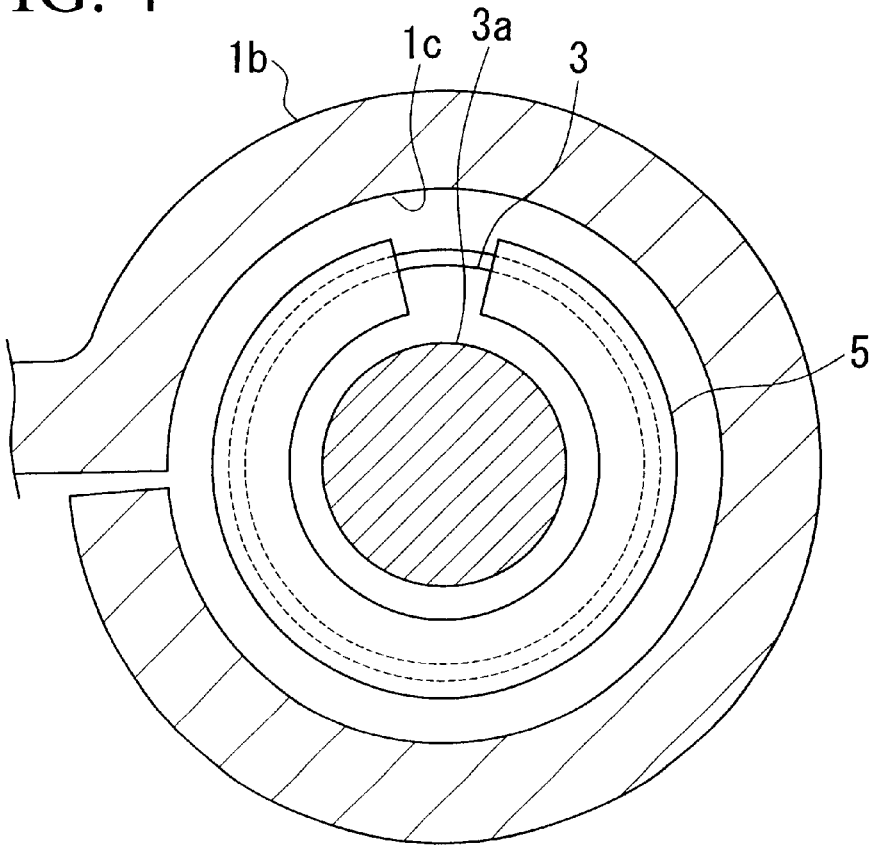
FIG. 4 is a cross-sectional view along the line IV—IV in FIG. 1.

The piece 1 is manufactured by the processing of a metal plate, and a pair of connecting pipes 1*a* having circular cross sections are provided at both ends of one side thereof and a connecting pipe 1*b* having a circular cross section with the same diameter as that of the connecting pipes 1*a* is provided at an intermediate portion of the other side thereof. These connecting pipes 1*a* and 1*b* are formed by bending the metal plate, and the connecting pipe 1*b* can be engaged between the connecting pipes 1*a* of the adjacent piece 1 so as to be aligned along the same axis. Furthermore, a pair of connecting grooves 1*c* are formed on the inner circumferential surface of the intermediate portions (the portions which are separated from both ends) of the connecting pipe 1*b*. The surfaces of these connecting grooves 1*c* are tapered along the longitudinal direction of the connecting pipe 1*b* to form a V-shape in their cross section as shown in FIG. 1.

The connecting pin 3 is inserted into the aligned connecting pipes 1*a* and 1*b* for swingably connecting the adjacent pieces 1. The outer diameter of the connecting pin 3 is slightly (about 0.5 mm for example) smaller than the inner diameter of the connecting pipes 1*a* and 1*b*, and the length of connecting pin 3 is shorter than the width of the piece 1. Furthermore, a pair of installation grooves 3*a* having rectangular cross sections are formed on the circumferential surface of the connecting pin 3 so as to project toward the connecting grooves 1*c*, and the edges of the end surfaces of the connecting pin 3 are chamfered.

Each spring ring 5 is formed by bending a rod having a circular cross section and made of an elastic material such as spring steel to form a C-shape so as to be able to change the diameter elastically. The normal (enlarged) outer diameter of the spring ring 5 is smaller than the diameter of the bottom surface of the connecting groove 1*c* and larger than the diameter of the connecting pin 3, and the inner diameter of the spring ring 5 is smaller than the diameter of the connecting pin 3 and larger than the diameter of the bottom surface of the installation groove 3*a*. The spring ring 5 is engaged with each installation groove 3*a* of the connecting pin 3 and inserted into the connecting pipes 1*a* and 1*b* together with the connecting pin 3 by reducing the diameter. Furthermore, the outer part of each spring ring 5 is engaged with each connecting groove 1*c* of the connecting pipe 1*b* by enlarging the diameter to its normal size when the spring ring 5 overlaps with the connecting groove 1*c*.

Next, an embodiment of the connecting procedure of the adjacent pieces 1 will be explained. First, each spring ring 5 is enlarged and engaged with each installation groove 3*a* of the connecting pin 3. In this situation, the spring ring 5 is easily enlarged by fitting and pressing against the chamfered end surface of the connecting pin 3, and the spring ring 5 is easily engaged with the installation groove 3*a* by sliding along the longitudinal direction of the connecting pin 3 until the spring ring 5 overlaps with the installation groove 3*a* and the diameter returns to its normal size.

Secondly, the connecting pin 3, in which two spring rings 5 are engaged, is inserted into the connecting pipe 1*a* of the piece 1, and when one of the spring rings 5 makes contact with the end of the connecting pipe 1*a*, this spring ring 5 recedes into the installation groove 3*a* and is pushed into the connecting pipe 1*a*. As a result, the insertion of the connecting pin 3 continues. In this case, the connecting pin 3 can be inserted into the engaged connecting pipe 1*a* from either side (upper or lower side in FIG. 1).

When the tip of the connecting pin 3 is inserted into the connecting pipe 1*b* and one of the spring rings 5 overlaps with one of the connecting grooves 1*c*, the diameter of the spring ring 5 which has receded into the installation groove 3*a* returns to its normal size in the connecting groove 1*c*. As a result, the spring ring 5 engages with the connecting groove 1*c* and further insertion of the connecting pin 3 is resisted. However, by pushing the connecting pin 3 with a force larger than the resistive force produced by the engagement between the spring ring 5 and the connecting groove 1*c*, the spring ring 5 gradually recedes into the installation groove 3*a* along the tapered surface of the installation groove 3*a*, and the connecting pin 3 can be further inserted into the connecting pipes 1*a* and 1*b*.

Furthermore, when the tip of the connecting pin 3 is passed through the connecting pipe 1*b* and inserted into the other connecting pipe 1*a* until both spring rings 5 overlap with the corresponding connecting grooves 1*c*, the outer surfaces of the spring rings 5 are respectively engaged with the connecting grooves 1*c* simultaneously. As a result, the connecting pin 3 is fastened to the connecting pipes 1*a* and 1*b* and the adjacent pieces 1 are connected. In this fastened position, the connecting pin 3 cannot easily be pulled out from the connecting pipes 1*a* and 1*b*, and the connection of the pieces 1 is maintained. In addition, there is some play between the connecting grooves 1*c* and the spring rings 5 which varies in compliance with the size of the V-shaped connecting grooves 1*c* and the amount of radial deformation of the spring rings 5; however, since the length of the connecting pin 3 is sufficiently shorter than the width of the piece 1, the projection of the end of the connecting pin 3 from the piece 1 is prevented despite the presence of play.

For the case when the piece 1 should be removed, the connecting pin 3 is moved with a force exceeding the engagement force of the two spring rings 5 and the diameter of the spring ring 5 is forcibly reduced along the tapered surface of the installation groove 3*a* as described above. As a result, the connecting pin 3 can be pulled out from the connecting pipes 1*a* and 1*b*, and the piece 1 can be removed from the adjacent pieces 1.

In the above described structure, the spring rings 5 are only deformed when the spring rings 5 are shifted in the connecting pipes 1*a* and 1*b* during insertion or removal, and the spring rings 5 fasten the connecting pin 3 to the connecting pipes 1*a* and 1*b* without using an elastic force, at their normal size which do not deform. Therefore, unlike the conventional fastening system which continuously fastens the connecting pipe through the use of an elastically deformed fastening member, a predetermined fastening force can be stably obtained by the spring rings 5. Actually, in the present invention, there is no limitation for repetitive use of the spring rings 5 because the spring rings 5 do not fatigue. Furthermore, unlike the conventional fastening system, the designed fastening force can precisely be obtained because friction has no direct influence on the fastening, and therefore, the reliability of the product is improved. Moreover, the adjacent pieces 1 can be easily and rapidly connected without considering the adhesion of machine oil by using the connecting structure of the present invention which possesses high operability. In addition, the connecting pipes 1*a* and 1*b* can be easily bored by using only one kind of drilling tool because the connecting pipes 1*a* and 1*b* have the same diameters.

Figure 5:
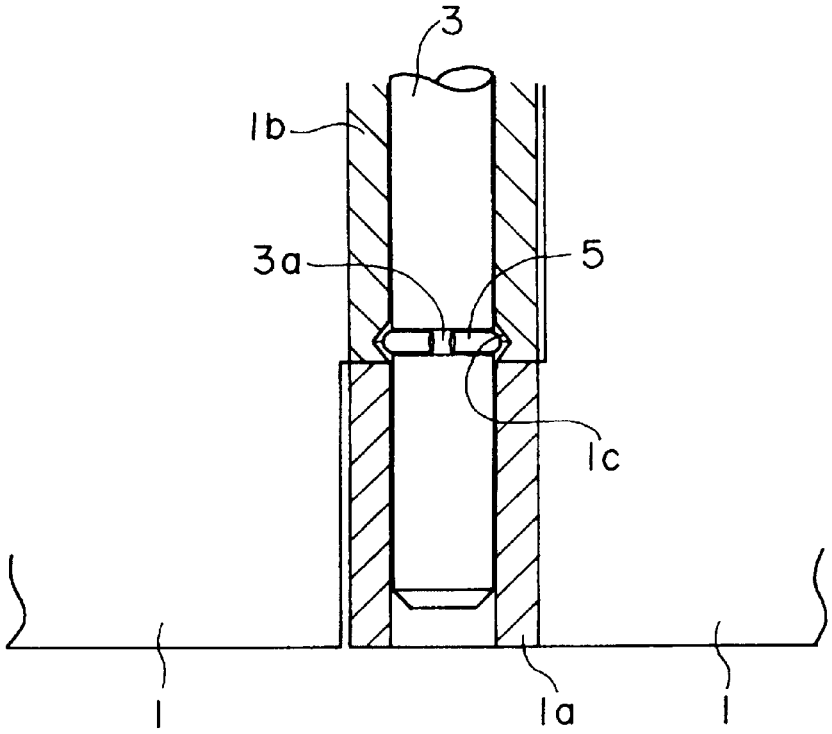
FIG. 5 is a cross-sectional view of the connecting pin in which the connecting groove is formed in another position.
Figure 6:
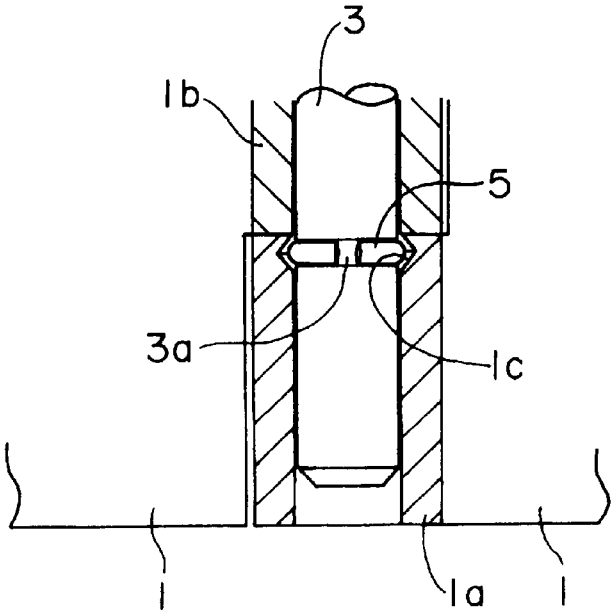
FIG. 6 is a cross-sectional view of the connecting pin in which the connecting groove is formed in another position.
Figure 7:
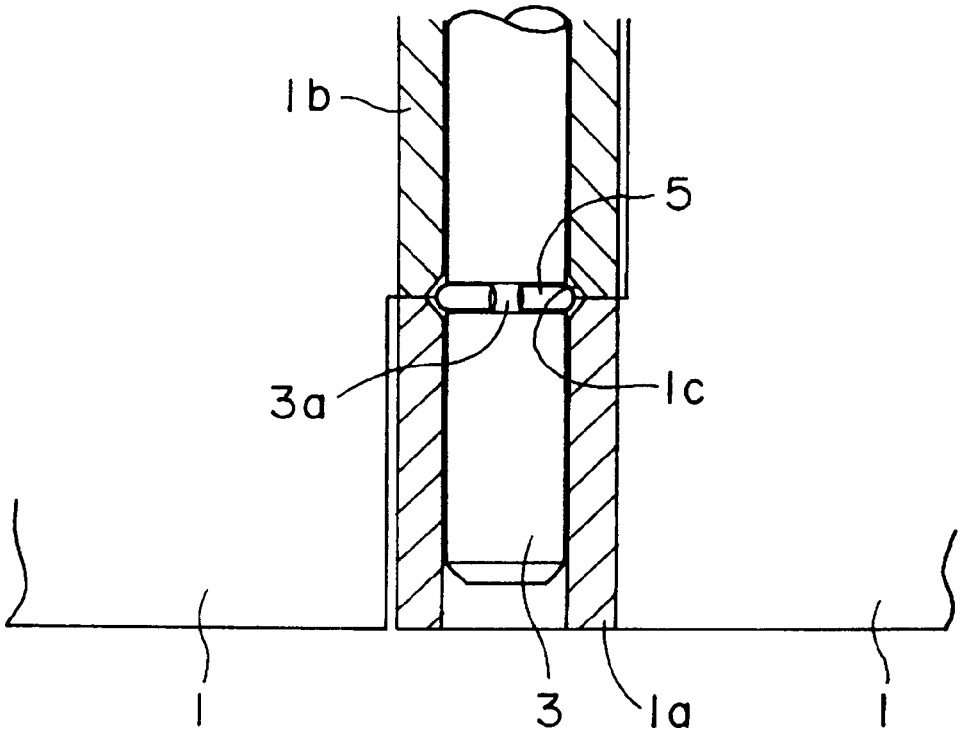
FIG. 7 is a cross-sectional view of the connecting pin in which the connecting groove is formed in another position.

In the present invention, the connecting grooves 1*c* can be provided at both ends of the connecting pipe 1*b* as shown in FIG. 5 (only one end is shown in the figure), or provided at the inner end of each connecting pipe 1*a* as shown in FIG. 6. Furthermore, the connecting grooves 1*c* can also be provided across both ends of the connecting pipe 1*b* and the inner ends of the connecting pipes 1*a* as shown in FIG. 7. By providing the connecting grooves 1*c* in this manner, the connecting grooves 1*c* can easily be formed on the connecting pipes 1*a* and 1*b* at low cost. The connecting grooves 1*c* may also be provided at an intermediate position of each connecting pipe 1*a*. In this structure, an outlook of the connecting portion between the adjacent pieces 1does not get worse because the spring rings 5 are entirely hidden in the connecting pipes 1*a*.

In the connecting structure in which the adjacent pieces are connected by a pair of connecting pipes 1*a* and a connecting pipe 1*b* which is engaged between the connecting pipes 1*a* (the total number of connecting pipes between the adjacent pieces 1 is not limited to three, and more than four connecting pipes can be provided), normally, two or more connecting grooves 1*c*, as shown in FIGS. 1 to 4 or FIGS. 5 to 7, are provided. However, in theory, the connection of the adjacent pieces 1 can be accomplished with only one connecting groove 1*c*.

Furthermore, in these figures, the connecting grooves 1*c* form a V-shape provided by the two tapered surfaces; however, the V-shaped connecting grooves 1*c* may also be provided by a surface perpendicular to the axis of the connecting pipe and a tapered surface. In this case, when a plurality of connecting grooves 1*c* is provided, these connecting grooves 1*c* should be arranged so as to face the tapered surfaces in the same direction.

The connecting pipes 1*a* and 1*b* can also be formed by prefabricated tube to or by a boring process, however, the connecting tubes 1*a* and 1*b* are usually formed by bending the plate as described above. In this case, forming the connecting grooves 1*c* before bending is easier than forming the connecting grooves 1*c* after bending.

In addition, the normal outer diameter of the spring rings 5 may be larger than the diameter of the bottom surface of the connecting grooves 1*c*. In this case, the spring rings 5 which are engaged with the connecting grooves 1*c* are enlarged until almost their normal size without being fully enlarged, and can fasten the connecting pin 3 to the connecting pipes 1*a* and 1*b* by elastically contacting the outer surfaces of the spring rings 5 with the bottom surfaces of the connecting grooves 1*c*.

Figure 8:
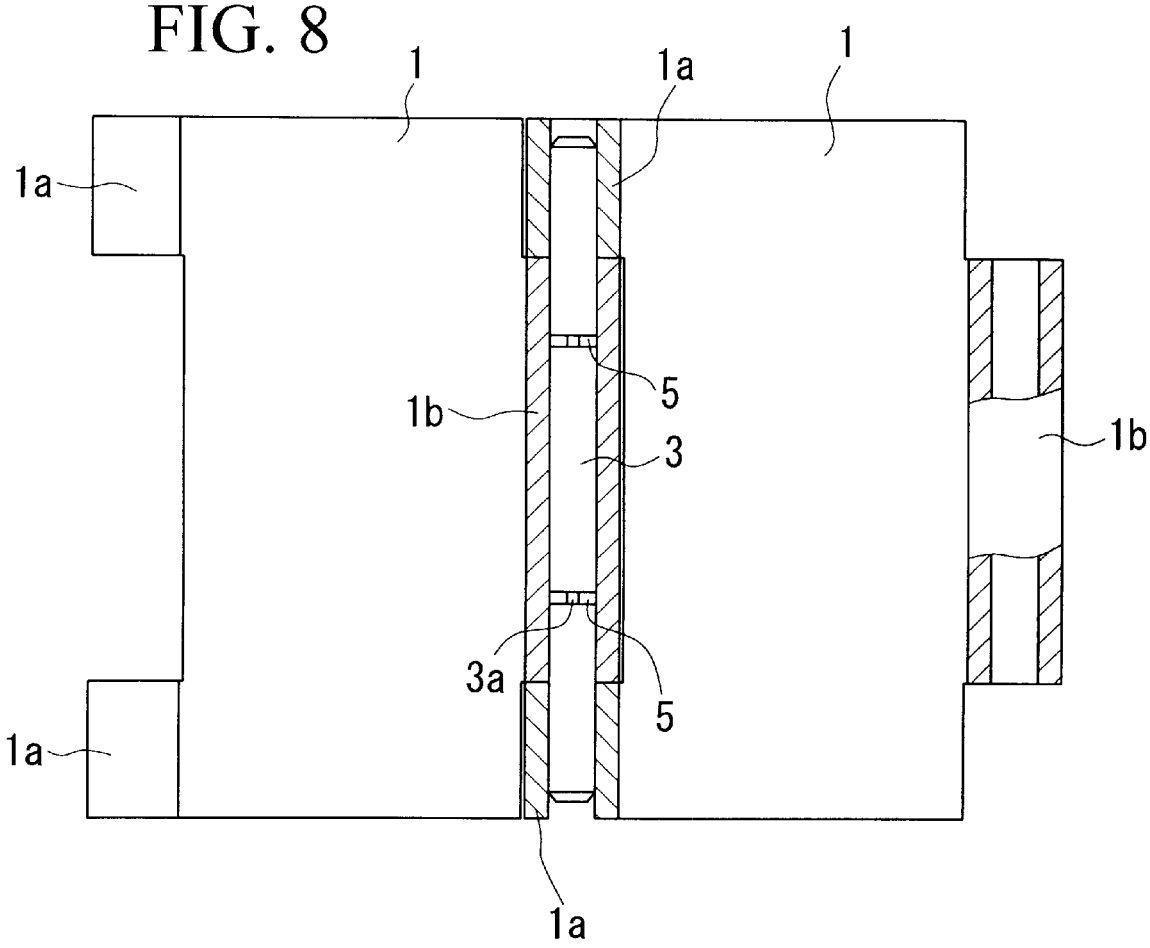
FIG. 8 is a cross-sectional view of an another embodiment of the connecting structure for the pieces and the like of the present invention.

FIG. 8 shows the another embodiment of the present invention.

In this connecting structure, the connecting grooves 1*c* of FIG. 1 are not formed on the connecting pipe 1*b*, and the spring rings 5, which are forcibly inserted into the connecting pipes 1*a* and 1*b* together with the connecting pin 3 by reducing the diameter of the spring rings 5, fasten the connecting pin 3 to the connecting pipes 1*a* and 1*b* by enlarging the diameter of the spring rings 5 until almost their normal size and by elastically contacting the outer surfaces thereof with the inner surface of the connecting pipe 1*b*.

According to this structure, the connection of the adjacent pieces 1 can be performed very easily and quickly, and the structure can easily be processed at low cost because the operation for forming the connecting grooves 1*c* is not required. Furthermore, the spring rings 5 can also be engaged with the inner surface of the connecting pipes 1*a* by changing the positions of the installation grooves 3*a*.

In each spring ring 5 of FIGS. 1 to 8, the inner shape thereof is a true-circle 0.8 mm in diameter and the outer shape thereof is a true-circle 1.3 mm in diameter, for example, and the width of the opening w5 between the opening ends 5*a* (refer to FIG. 3) of the spring ring 5 is 0.2 mm, for example. However, a spring ring 7 which is not a true-circle, as shown in FIG. 9, can also be used.

Figure 9:
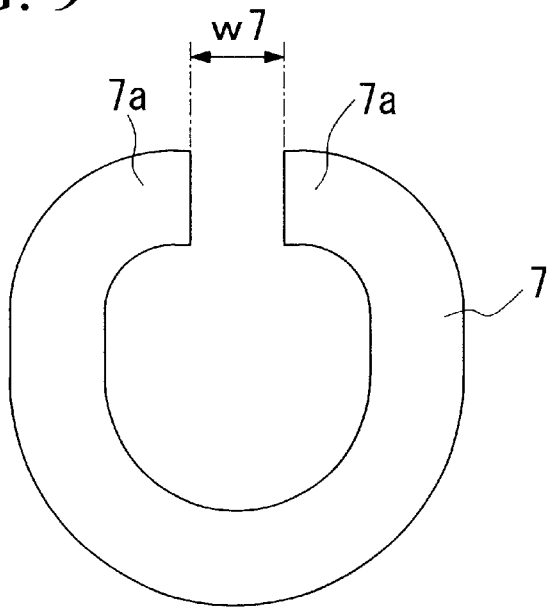
FIG. 9 is a plan view of an another embodiment of the spring ring of the present invention.

The shape of the spring ring of FIG. 9 is a true-circle which is similar to the above-described spring ring 5, in one half thereof (lower part in the figure) and also has a rectangular shape in the other half thereof (upper part in the figure). Furthermore, the width of the opening w7 between the opening ends 7*a* which are positioned in the rectangular-shaped portion of the spring ring 7 is 0.3 mm, each bending portion which leads to the opening ends 7*a* has an arc 0.2 mm in radius, and the inner width and maximum outer width of the spring ring 7 in the vertical direction of FIG. 9 are respectively 0.85 mm and 1.35 mm, for example.

In this spring ring 7, there is an advantage in that the slipping out of the spring ring 7 from the installation groove 3*a* becomes difficult when the spring ring 7 is engaged with each installation groove 3*a* of the connecting pin 3 before the insertion into the connecting pipes 1*a* and 1*b*, because the installation groove 3*a* is held between the straight lined portions of the spring ring 7 which lead to the opening ends 7*a* and which are difficult to deform by an external force.

In addition, it is needless to say that the size and shape of the spring rings 5 and 7 are not limited to the above-described examples.

Furthermore, not only can the connecting structure of the present invention be applied to the connection between the adjacent pieces 1, but it also can be applied to the connection between the piece 1 and a case or a buckle of the watch. Moreover, not only can the connecting structure of the present invention be applied to the connection of the wristband and the like which are made of metals, but it also can be applied to the connection of the wristband and the like which are made of ceramics or rubbers in which the metal connecting pipes are built-in.

What is claimed is:

1. A connecting structure for swingably connecting two adjacent parts of a band, comprising:

a plurality of connecting pipes which are provided on said adjacent parts and are aligned along an axis;

a connecting pin which is inserted into said plurality of connecting pipes; and pin in a C-shaped spring ring located in an installation groove of said connecting pin in a manner such that the diameter of said spring ring can be reduced;

wherein together with said connecting pin, said spring ring is inserted into said connecting pipes by reducing the diameter of said spring ring, and fastens said connecting pin to said connecting pipes by enlarging the diameter of said spring ring inside said connecting pipes until the outer surface of said spring ring contacts the inner surface of a said connecting pipes so as to enable rotation of said connecting pipes around said connecting pin.

2. A connecting structure according to claim 1, wherein said spring ring is enlarged in a tapered connecting groove provided on the inner surface of a said connecting pipes, and fastens said connecting pin to said connecting pipes by engaging the outer part of said spring ring to said connecting groove.

3. A connecting structure according to claim 2, wherein at least one of said connecting grooves is provided at an intermediate portion along the longitudinal direction of said aligned connecting pipes.

4. A connecting structure according to claim 2, wherein said aligned connecting pipes are composed of a pair of first connecting pipes which are provided at both sides of an end of one of the adjacent parts and a second connecting pipe which is provided at an intermediate portion of the other of the adjacent parts, the second connecting pipe is fitted between said pair of first connecting pipes, and said connecting groove is provided at one of the end portions of either of said first or second connecting pipes.

5. A connecting structure according to claim 2, wherein said aligned connecting pipes are composed of a pair of first connecting pipes which are provided at both sides of an end of one of the adjacent parts and a second connecting pipe which is provided at an intermediate portion of the other of the adjacent parts, the second connecting pipe is fitted between said pair of first connecting pipes, and said connecting groove is provided across the end portions of both of said first and second connecting pipes.

6. A connecting structure according to claim 1, wherein a pair of portions which lead to opening ends of said spring ring have straight-lined shapes.

7. A structure for swingably connecting two adjacent parts of a band comprising:

first and second generally rectangular parts;

at least one hollow pipe mounted on an edge of each said first and second part with the center of said hollow pipes aligned along a common axis;

a connecting groove formed on the interior surface of at least one of said pipes;

a connecting pin of a diameter less than the diameter of the interior of said connecting pipes inserted into said plurality of connecting pipes on said common axis, said connecting pin having an installation groove formed on its outer surface; and a C-shaped spring ring mounted in said connecting pin installation groove and having a diameter when compressed to fit into the interior of said connecting pipes and expanding to fit into said connection groove of a said connecting pipe.

8. A structure as claimed in claim 7, wherein there are two spaced pipes on said first part and one pipe on said second part that fit into the space between said two pipes on said first part.

9. A structure as claimed in claim 8, wherein there are two spaced connecting grooves on the interior of said one pipe of said second part.

* * * * *